United States Patent [19]

Austin, Jr. et al.

[11] Patent Number: 4,691,948

[45] Date of Patent: Sep. 8, 1987

[54] FAIL-SECURE LOCK SYSTEM

[75] Inventors: George K. Austin, Jr., Newberg; Larry D. Lietz, Dundee, both of Oreg.

[73] Assignee: A-DEC, Inc., Newberg, Oreg.

[21] Appl. No.: 802,533

[22] Filed: Nov. 27, 1985

[51] Int. Cl.[4] ..... E05C 1/12

[52] U.S. Cl. ..... 292/171; 292/144

[58] Field of Search ..... 292/144, 171, 201, 141

[56] References Cited

U.S. PATENT DOCUMENTS

| | | | |
|---|---|---|---|
| 795,897 | 8/1905 | Criqui . | |
| 819,208 | 5/1906 | Criqui . | |
| 1,000,268 | 8/1911 | Jadronja . | |
| 1,050,556 | 1/1913 | McGill . | |
| 1,164,877 | 12/1915 | Schulz . | |
| 1,529,353 | 3/1925 | Hall . | |
| 1,722,621 | 7/1929 | Bennett | 292/171 X |
| 1,857,654 | 5/1932 | Mylar . | |
| 2,541,723 | 2/1951 | Shaw et al. | 292/171 X |
| 2,879,725 | 3/1959 | Zuver | 292/144 X |
| 3,234,766 | 2/1966 | O'Brien | 292/144 X |
| 3,830,332 | 8/1974 | Fontaine | 180/113 |
| 3,924,427 | 12/1975 | San Juaquin | 70/264 |
| 3,953,991 | 5/1976 | Grossman | 70/104 |
| 4,434,635 | 3/1984 | Borgato | 70/279 |
| 4,465,311 | 8/1984 | Austin | 292/144 |
| 4,509,347 | 4/1985 | Young | 292/144 X |
| 4,593,543 | 6/1986 | Stefonek | 292/144 X |

*Primary Examiner*—Richard E. Moore

*Attorney, Agent, or Firm*—Klarquist, Sparkman, Campbell, Leigh & Whinston

[57] ABSTRACT

A fail-secure lock apparatus includes a normally pneumatically actuated locking bolt that can be manually operated to withdraw the same in the event of a power failure. The apparatus incorporates a standard key operated lockset connected to operate the pneumatic power drive means or, in the event of a power failure, is connected to rotate a cable reel mechanically to effect movement of the locking bolt to the unlocked position.

9 Claims, 6 Drawing Figures

FAIL-SECURE LOCK SYSTEM

The present invention relates to a fail-secure lock system using normally pneumatically actuated bolts that can be operated manually to withdraw the lock plunger from the locked position in the event of power failure.

It is convenient in many custodial systems, such as penitentiaries, to provide pneumatically operated locks on individual doors, such as cell doors, that can be operated from a remote location or at the cell door. However, such a locking system could provide a hazard in the event that an electrical or pneumatic system fails.

It is a principal object of the present invention to provide a fail-secure lock system of the type described which permits manual operation of the individual door locks in the event of a power or air failure.

More particularly, it is an object of the present invention to provide a fail-secure system of the type described that incorporates a standard key operated lock set that will enable operation of the bolt to withdraw it to an unlocked position by the intervention of pneumatic power or, in the event of the failure of such power, mechanically to effect movement of the bolt to open position. These and other advantages of the invention will become more apparent hereinafter.

SUMMARY OF THE INVENTION

The invention is a mortise lock mechanism for a door or the like having a means operable through a conventional lock set for both actuating power drive means to retract a latch bolt as well as manually retracting the latch bolt.

Figure 1:
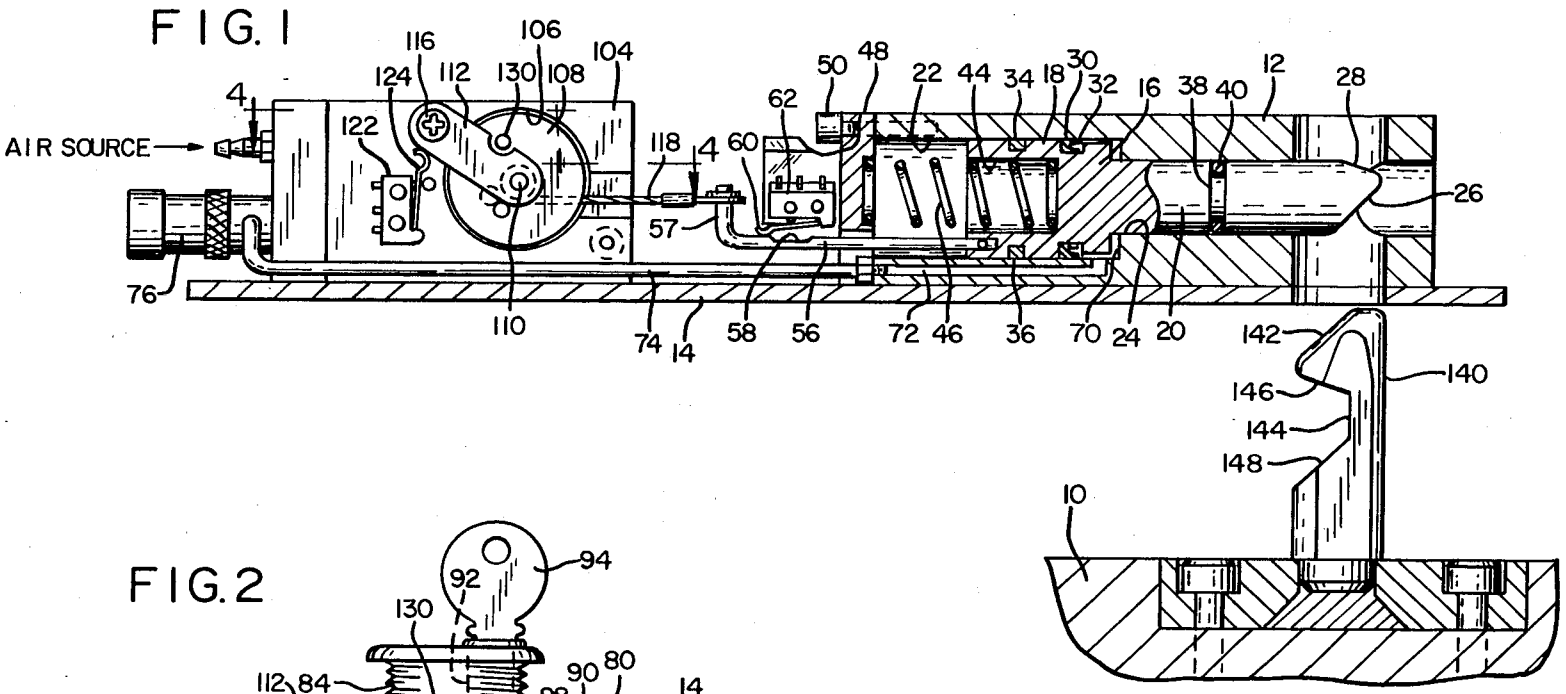
FIG. 1 is a fragmentary view of a lock made in accordance with the invention, partially in cross-section, showing the same in an unlatched condition.
Figure 6:
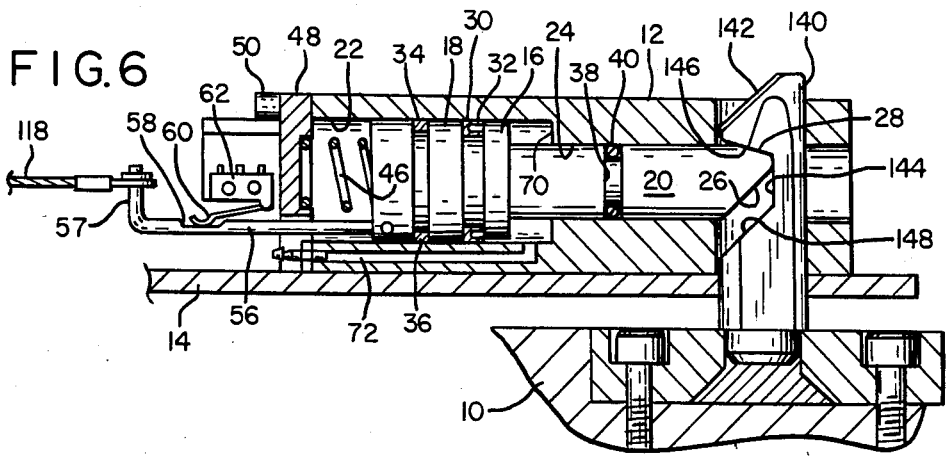
FIG. 6 is a fragmentary sectional view of the lock showing it in its latched condition.

Referring now to the drawings, and more particularly to FIGS. 1 and 6, the illustrated embodiment shows a locking assembly adapted to be mounted in the frame of a building structure for locking a sliding door 10 in closed position. The locking assembly includes a cylinder body 12 affixed to a mounting plate 14 by any suitable means (not shown) by means of which plate the lock can be suitably mounted in a door jamb. Contained within the body 12 is a latch bolt 16 including a head portion 18 and a stem 20. The head 18 slides within a cylinder portion 22 formed in the body 12. The stem 20 slides within a cooperative bore 24 coaxial with the cylinder 22. The end of the stem 20 is formed with a beveled end surface 26, preferably extending at a 45° angle with respect to the axis of the stem. The stem is also provided with a surface 28 opposite the surface 26 that is inclined at an angle of 15° with respect to the axis of the stem. More will be said of these surfaces subsequently. The head 18 is formed with a groove 30 in which is received a U-cup seal 32 and a further groove 34 in which is received a Teflon ring 36. The stem 20 is provided with a peripheral groove 38 in which is received an O-ring 40. The ring 40 and U-cup serve to contain lubricant which is positioned in the cavity therebetween to help lubricate the sliding motion of the latch bolt 16 relative to the body 12 and also to provide air seals.

The end of the head portion 18 is provided with a counter-bore 44 in which is received a coil spring 46 which also bears against an end cap 48 secured to the end of the body 12 by screws 50 or other suitable means. The spring 46 is a compression spring which is adapted to bias the latch bolt 16 to the position shown in FIG. 1.

Secured to the latch bolt 16 and extending outwardly through the cap 48 is an actuator rod 56 having a transversely extending end portion 57. The actuator rod 56 is provided with a notch 58 in the wall thereof outwardly of the end cap 48, which notch is adapted to receive the actuating arm 60 of a normally open microswitch 62 when the latch bolt is in the locked position as shown in FIG. 6. When the latch bolt 16 is in the fully retracted position as indicated in FIG. 6, or in the fully extended position as shown in FIG. 1, the switch actuator 60 is positioned so as to close the switch. In the closed position of the switch 62 a warning light will be operated as described hereinafter to indicate the unlocked position of the lock system.

Means are provided for effecting withdrawal of the lock bolt 16 to the unlocked position. The primary means for effecting such withdrawal is a pneumatic system arranged to supply air under pressure to the cylinder 22 at the end 70 thereof. Such air is supplied through a passageway 72 provided in the body 12, as best shown in FIG. 1. Air is supplied to the passageway 72 through a tube 74 connected to a solenoid operated three-way valve 76 supplied with air under pressure from a suitable source (not shown). Upon opening of the valve 76, air from the high pressure source will flow through the tube 74 and passageway 72 to the end 70 of the cylinder, causing the piston of the latch bolt to be moved to the left and thereby effecting withdrawal of the latch bolt from the locking position to the position indicated in FIG. 6.

The valve 76 may be operated from a remote position through an electrical circuit to be described or, alternatively, may be operated through the manipulation of a key at the site of the lock.

Figure 3:
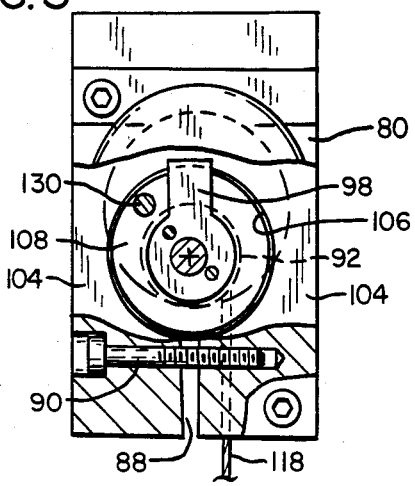
FIG. 3 is a sectional view taken along line 3—3 of FIG. 4.
Figure 4:
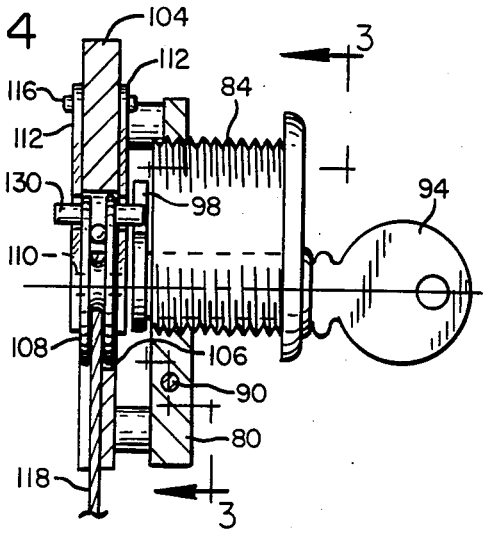
FIG. 4 is a sectional view taken along line 4—4 of FIG. 1.

Mounted on the plate 14 along opposite side edges thereof are a pair of mounting blocks 80, 82 for supporting, one in each, a pair of mortise cylinder locks 84, 86, respectively. The mounting blocks 80, 82 are provided with openings into which the cylinder of the respective locks may be inserted. The mounting blocks 80, 82 are each provided with a slot from the opening therein to an edge, as indicated at 88 in FIG. 3, and a locking screw 90 is provided from one portion of the block to the other through said opening so as to effect clamping of the block on the lock cylinder when it is installed at the proper location to prevent the cylinder from rotating.

Figure 2:
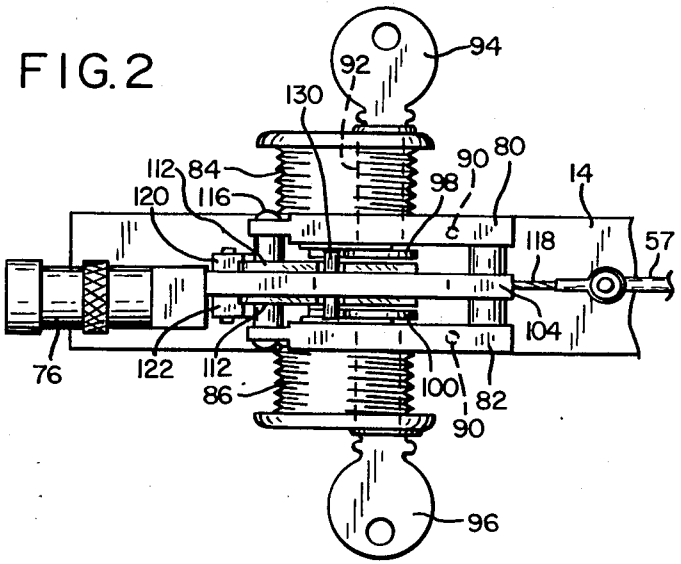
FIG. 2 is a top plan view of a portion of the lock.

Each of the locks 84, 86 is provided with the conventional key operated plug, such as indicated in dotted lines at 92 in FIG. 2. To effect operation of the plugs, keys 94, 96 may be inserted therein in conventional manner. Secured to the plug of the lock 84 is an operating lever 98, and secured to the plug of the lock 86 is an operating lever 100. The lock 84 is of the type that operates when the key 94 is rotated in a clockwise direction, whereas the lock 86 is of a type that operates when the key 96 is rotated in a counter-clockwise direction. Thus, rotation of the keys 94, 96 will cause rotation of the plug of the respective lock to rotate in the same direction as the key thereof, the purpose of which will be more fully described hereinafter.

Mounted between the blocks 80, 82 on the base 14 is a further mounting block 104 having a circular aperture 106 within which is mounted a spool 108. The spool 108 is rotatably supported on an axle 110 supported on its opposite ends by mounting plates 112 fixedly secured to the opposite sides of the block 104 by screws 116. Secured to the spool 108 is a length of plastic covered cable 118, the opposite end of which is secured to the rod 56 so that upon rotation of the spool 108 the cable will be wound thereupon to pull the rod 56 toward the spool and thus pull the latch bolt 16 towards its unlocking position.

Mounted, one on each of the opposite sides of the mounting block 104, are a pair of normally closed microswitches 120, 122. Referring to FIG. 1, each of the switches has an actuating arm such as that indicated at 124 for the switch 122. In the normal condition of the locks 84, 86, the arm 124 will be depressed by the engagement therewith of corresponding operating levers 98, 100 and the switches 120, 122 will be maintained open. However, upon rotation of one of the keys 94, 96, and thereupon the corresponding operating lever 98 or 100, the lever will be rotated free of the operating member 124, permitting the corresponding switch to close. Closure of the switch 120 or 122 will cause an electrical circuit to close that will be described hereinafter to operate the solenoid valve 76 to pass air to the cylinder 22 to effect withdrawal of the latch bolt as previously described. However, in the event of failure of the electrical circuit or the pneumatic system supplying air, the fail-secure arrangement of the invention can be utilized to effect withdrawal of the latch bolt. Thus, in the event of such failure, continued rotation of, for example, the key 96 will cause the operating lever 100 to continue to rotate and will bring it into engagement with a pin 130 projecting from the side surface of the spool 108. This will cause the spool 108 to rotate in a clockwise direction as it is shown in FIG. 1, winding the cable 118 thereon and causing the latch bolt 16 to be withdrawn to its fully open position.

Thus, the latch bolt 16 can be withdrawn either through the use of power or manually in the event of power failure.

Referring now to FIGS. 1 and 6, the latch bolt 16 is adapted to cooperate with a strike bolt 140 when the door 10 is moved to closed position to hold such door in such position. The strike bolt 140 is thus provided with an end surface 142 sloped at a 45° angle with respect to the longitudinal axis of the strike bolt and which is adapted cooperatively to engage the surface 26 of the latch bolt as the door moves towards closed position. The movement of the door 10 will thus cam the latch bolt towards its open position until the end of the latch bolt clears the end of the surface 142 whereupon the latch bolt will be urged to its closed position by the spring 46 fully to engage within the locking notch 144 provided in the latch bolt 140. The notch 144 is defined by opposed side surfaces 146, 148. The surface 148 is likewise inclined at a 45° angle with respect to the axis of the bolt, whereas the surface 146 is inclined at a 15° angle with respect to the perpendicular to the strike bolt axis. Thus, as soon as any retractive movement of the latch bolt 16 occurs, the surfaces 146, 28 will disengage to minimize the resistance to withdrawal movement of the latch bolt 16. On the other hand, the 15° angle is so slight that a retractive force applied to the door 10 of even very substantial magnitude will not cause sufficient force to be applied to the latch bolt 16 to overcome the resistance of a spring 46 having compressive resistance of about fifteen pounds.

Figure 5:
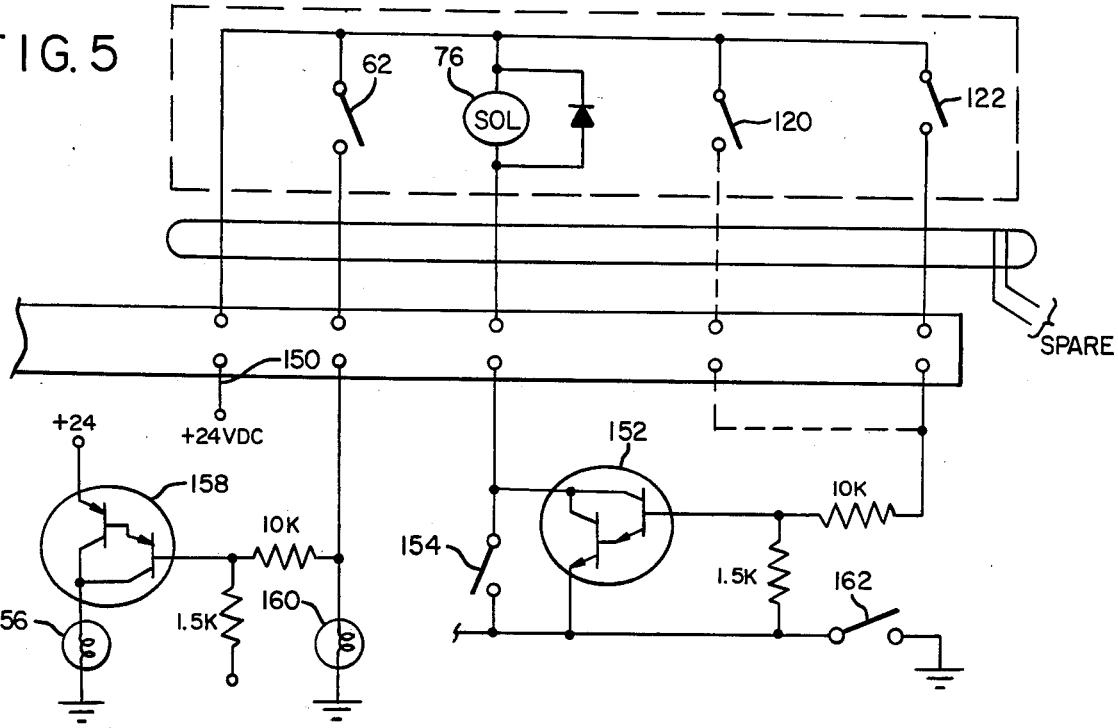
FIG. 5 is a schematic electrical diagram.

Shown in FIG. 5 is a schematic wiring diagram of the circuitry for a lock constructed in accordance with the invention. The circuit is adapted to be connected to a suitable source of 24 volt DC supply through a line 150. This is supplied to one side of the solenoid valve 76, the other side of which is connected to ground through an NPN transistor switch 152 which is normally biased off. Closure of either of the key operated switches 120, 122 will apply a voltage to the transistor switch 152, causing it to conduct, whereupon the solenoid valve 76 will operate to open, passing air as hereinbefore described to the latch bolt cylinder to open the lock. The lock can also be operated to open by means of a remotely located switch 154.

When the door 10 is in the closed position, the microswitch 62 will be in its normally open position. To indicate that the door is in its closed position, a green indicator light 156 is provided. This is controlled through an PNP transistor switch 158 which is normally biased on. As long as the switch 62 is open, the switch 158 will continue to conduct current through the green indicator light 156, indicating the door is locked. However, upon retraction of the latch bolt 16 to a fully open position, or upon opening of the door 10 and relaxing of the latch bolt 16 to the position shown in FIG. 1, the switch 62 will be moved to its closed position. This will place a bias upon the switch 158, causing it to cease conducting, whereupon the green light will be extinguished. However, closure of the switch 62 will close the circuit through a red indicator light 160, thereby indicating that the door 10 is open.

The system is also provided with a normally closed master gang lock switch 162. When this is open, as shown in FIG. 5, all circuits are rendered non-functional, except that through the light 156. Thus, a number of doors can be rendered non-openable as, for example, in a cell block.

It will be apparent that the lock can utilize only a single mortise switch and that it is adaptable to swinging doors, as well.

Having illustrated and described a preferred embodiment, it should be apparent the invention permits of modification in arrangement and detail.

What is claimed is:

1. A lock mechanism for a door or the like comprising:

a frame, a latch bolt, a cylinder body fixedly mounted on said frame and slidably receiving the latch bolt for movement between an extended locking position and a retracted unlocked position, spring means operatively arranged between said body and latch bolt to bias said latch bolt toward said locking position, said body and latch bolt defining a piston and cylinder means adapted upon the introduction of air therebetween to cause said latch bolt to be urged toward said unlocked position, conduit means for supplying air under pressure to said piston and cylinder means, said conduit means including a solenoid operated three-way valve for controlling the flow of air to and from said piston and cylinder means, circuit means connected to said solenoid for effecting operation thereof, switch means in said circuit, a mortise lock having a key rotatable plug mounted in said frame, an operating lever mounted on said plug and operatively connected to said switch to cause the same to close the circuit through said solenoid upon predetermined rotation of said plug whereby said solenoid operates said three-way valve to supply air under pressure to the cylinder body to move said latch bolt toward the unlocked position, said lever causing the switch to open the circuit through said solenoid upon counterrotation of said plug, whereby said solenoid operates said three-way valve to release air from the cylinder body and enable the spring means to bear said latch bolt toward the locking position, a spool, means rotatably mounting said spool in said frame, cable means connected to said latch bolt and to said spool whereby rotation of said spool will cause movement of said latch bolt toward said unlocked position, and means on said spool for operatively engaging said operating lever as the same is rotated with said key beyond a predetermined degree whereby further rotation of said key and operating lever causes said cable to be wound on said spool and said latch bolt to be moved to said unlocked position.

2. A mortise lock mechanism for a door or the like comprising:

a frame;

a latch bolt;

a cylinder body fixedly mounted on said frame and slidably receiving the latch bolt for movement of the latch bolt between an extended locked position and a retracted unlocked position;

power drive means for retracting the latch bolt;

a key operated lock set on said frame; and means operatively connecting said lock set to the power drive means for actuating the power drive means upon operation of said lock set; and means connecting said lock set to the latch bolt for effecting manual movement of said bolt upon operation of said lock set.

3. An apparatus according to claim 2 including bias means operatively arranged between said cylinder body and latch bolt for biasing said latch bolt toward said locked position.

4. An apparatus according to claim 3 wherein the power drive means includes pneumatic drive means and said cylinder body and latch define a piston and cylinder means adapted, upon the introduction of pressurized air therebetween, for causing said latch bolt to be urged toward said unlocked position.

5. An apparatus according to claim 4 including conduit means for supplying air under pressure to said piston and cylinder means, said conduit means including a solenoid operated three-way valve for controlling the flow of air to and from said piston and cylinder means, and electric circuit means, including switch means, connected to said solenoid for effecting operation thereof.

6. An apparatus according to claim 5 wherein said key set includes, a key lock having a key rotatable plug mounted on said frame;

operating lever means mounted on said plug for engaging said switch means for actuating said power drive means upon a first predetermined degree of rotation of said plug whereby said latch bolt is caused to move toward said unlocked position; and manual latch bolt retracting means operatively connected to said key rotatable plug for manual retraction of said latch bolt upon a second predetermined degree of rotation of said plug greater than said first predetermined rotation.

7. An apparatus according to claim 6 wherein said manual latch bolt retracting means comprises:

a spool;

means for rotatably mounting said spool on said frame;

cable means connected to said latch bolt and to said spool whereby rotation of said spool to wind said cable thereon causes movement of said latch bolt toward said unlocked position; and means on said spool for operatively engaging said operating lever means as the same is rotated with said key to said first predetermined degree of rotation, and further rotation of said key and operating lever causes said spool to rotate thereby to cause said latch bolt to move toward said unlocked position.

8. An apparatus according to claim 2 including indicator means operatively connected to said latch bolt for sensing movement thereof and remotely indicating when said latch bolt is retracted or extended.

9. An apparatus according to claim 6 including indicator means operatively connected to said latch bolt for sensing movement thereof and remotely indicating when said latch bolt is retracted or extended.

* * * * *

UNITED STATES PATENT AND TRADEMARK OFFICE

CERTIFICATE OF CORRECTION

PATENT NO. : 4,691,948

DATED : September 8, 1987

INVENTOR(S) : GEORGE K. AUSTIN, JR. and LARRY D. LIETZ

It is certified that error appears in the above-identified patent and that said Letters Patent is hereby corrected as shown below:

In the Claims:

Claim 4, column 6, line 3, after "latch" insert -- bolt --.

Signed and Sealed this

Eleventh Day of October, 1988

*Attest:*

*Attesting Officer*

DONALD J. QUIGG

*Commissioner of Patents and Trademarks*